United States Patent [19]

Brown, Jr.

[11] 4,172,608

[45] Oct. 30, 1979

[54] KNOCK DOWN CABLE REEL HOLDER

[76] Inventor: William E. Brown, Jr., P.O. Box 1080, Dallas, Tex. 75208

[21] Appl. No.: 940,841

[22] Filed: Sep. 8, 1978

[51] Int. Cl.[2] ..... B65H 17/46; B65H 75/22

[52] U.S. Cl. ..... 242/85; 242/115

[58] Field of Search ..... 242/85, 85.1, 86, 115, 242/127, 128, 129; 248/159

[56] References Cited

U.S. PATENT DOCUMENTS

| | | | |
|---|---|---|---|
| 1,557,887 | 10/1925 | Sheeley | 242/85 |
| 3,536,275 | 10/1970 | Solomon | 242/85 |
| 3,920,194 | 11/1975 | Parsen | 242/115 |
| 4,114,826 | 9/1978 | Diebolder | 242/85 |

*Primary Examiner*—Edward J. McCarthy

*Attorney, Agent, or Firm*—Hubbard, Thurman, Turner, Tucker & Glaser

[57] ABSTRACT

A portable support for cable reels comprising a rectangular base, at least one pair of vertical support elements, and at least one rod or shaft resting on the pairs of vertical support elements for supporting the cable reels. The horizontal base comprises four hollow channel members permanently connected at their ends and having apertures at the corners of the base for providing access to the interior of the hollow channels. Two opposed sides of the base have anchoring slots along an upper face by which the vertical support elements are anchored into the base. The tops of the vertical support elements also have slots in which the horizontal shaft rests. The base is provided with a handle attached to one of the sides adjacent to the upper face and a number of studs and matching holes for allowing a plurality of units to be stacked together. The dimensions of the various elements are selected so that the vertical support elements and horizontal shaft may be stored within the hollow channel members while the unit is carried by the handle.

7 Claims, 5 Drawing Figures

KNOCK DOWN CABLE REEL HOLDER

BACKGROUND OF THE INVENTION

This invention relates to cable reel holders and in particular to a portable cable reel holder which is easily disassembled and carried or stored in a very compact form.

Many types of commercial audio systems are used in commercial as well as residential structures. Such systems include telephone, intercom, and various music systems. Installation of such systems typically requires the stringing or pulling of numerous cables between various points within the structure. It is very helpful in such installations to have a support for reels of wire or cable which allows the cable to be uncoiled from the reel in an orderly fashion. The installation of such systems usually occurs in a relatively short time and the installer is preferrably able to move from one work location to another as quickly as possible. Thus, while such an installer has need for cable reel supports, he typically would prefer to not be burdened with bulky, heavy, and hard to handle equipment which must be moved to each job location. By their very nature, cable reel holders are typically large and difficult to transport.

SUMMARY OF THE INVENTION

Accordingly, an object of the present invention is to provide a portable cable reel holder which is easily disassembled and stored in compact form for easy transportation.

A cable reel holder according to the present invention comprises a rectangular base made of hollow channel members, at least one pair of vertical support members provided with means for anchoring to the base, and at least one shaft adapted for support by the pairs of vertical support elements. The base further includes a carrying handle attached to one side adjacent to the upper face of the base and alignment studs on the upper face of the base and holes on the upper and lower faces of the base to facilitate stacking of multiple cable reel holders. The hollow channel members have apertures for providing access to the interior of the hollow channels and the dimensions of the various parts are selected so that the vertical support members and horizontal shafts may be stored within the hollow channel members when the apparatus is not in use.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENT

Figure 1:
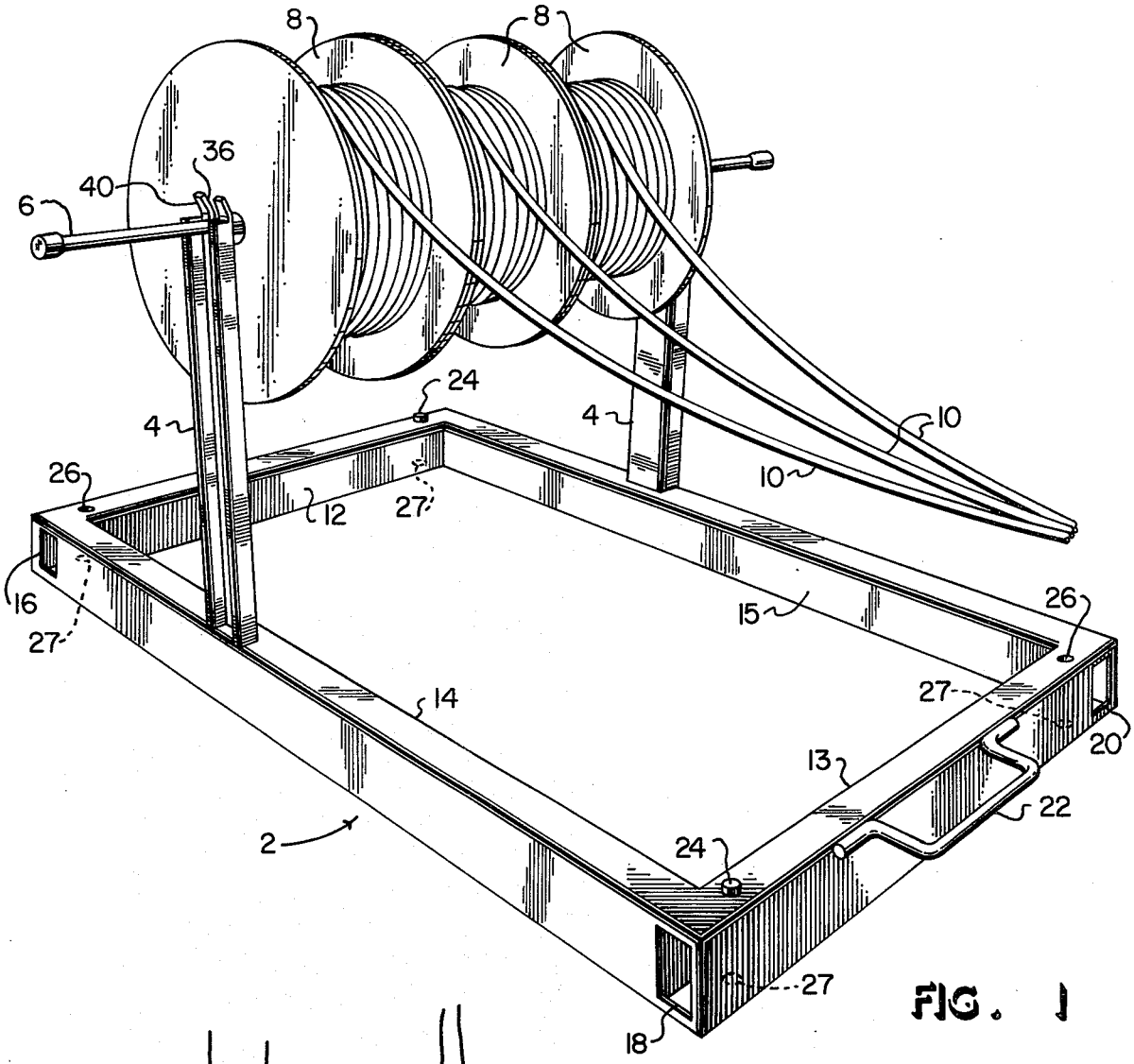
FIG. 1 is a perspective view of a cable reel holder according to the present invention in use with three cable reels.

With reference now to FIG. 1, there is illustrated a cable reel holder according to the present invention assembled and supporting three cable reels. The cable reel holder comprises basically a rectangular base 2, a pair of vertical support elements 4, and a horizontal shaft 6. In the illustration, shaft 6 is supporting three cable reels 8 so that three lengths of cable 10 may be simultaneously pulled from the reels 8.

The base 2 has four sides, 12, 13, 14 and 15, each comprising a hollow channel member. In the preferred form, each channel member has a rectangular cross section and therefore has an upper and lower face as well as an inner and outer face. As illustrated, at least three of the sides, 12, 13 and 15, have apertures, 16, 18 and 20, respectively, provided at one end thereof to allow access to the interior of the hollow channel members. The apertures 16, 18 and 20 are sized to allow the vertical supports 4 and shaft 6 to be inserted into the hollow channel members, but are smaller than the inside dimensions of the channel members, thereby forming small inwardly facing flanges with respect to the interior cross sectional area of the channel members adjacent apertures 16, 18 and 20. The base 2 preferably has a handle 22 permanently attached to side 13 adjacent or flush with the upper face of side 13. Also provided on the upper face of sides 12 and 13 are a pair of alignment studs 24 and a pair of corresponding alignment apertures 26. Corresponding apertures 27 in the lower face of sides 12 and 13 are illustrated in phantom. As will be explained further below, these alignment studs and holes allow multiple reel holders to be stacked for carrying or for storage.

The vertical support elements 4 are provided at their lower ends with anchoring means for engaging the top surface of opposite sides 14 and 15 of the base 2. This anchoring arrangement is described in detail with respect to FIGS. 3 and 4. As illustrated, each of the vertical supports 4 is a section of C-channel having a length equal at least to the radius of the largest size reel 8 which will be used. The upper end 40 of each vertical support 4 has a U-shaped slot or cradle 36 cut into the web of the C-channel for supporting the horizontal shaft 6. As illustrated, the arms of the C-channel are cut away at this upper end so that the web may be bent slightly outward to provide easier insertion of shaft 6 and to provide a wedge fit for the shaft as the shaft is inserted into slots 36.

Figure 2:
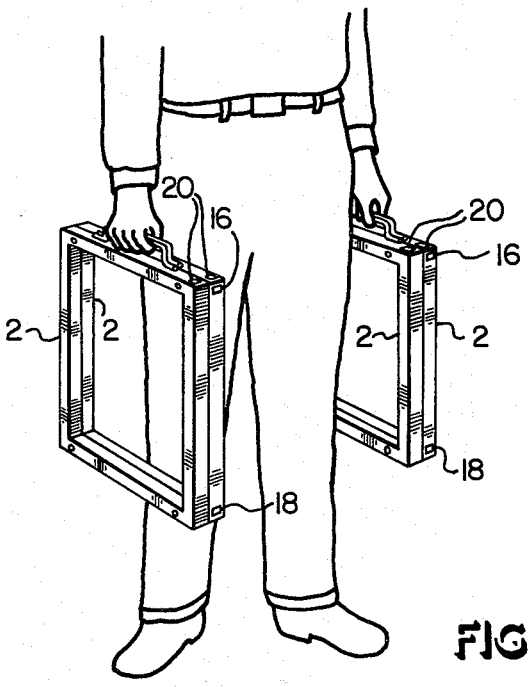
FIG. 2 is an illustration of four of the cable reel holders shown in FIG. 1 being carried in stacked configuration.

FIG. 2 illustrates the manner in which four cable reel supports of this invention may be hand carried. Only the bases 2 are visible in FIG. 2 because the vertical supports 4 and the horizontal shaft 6 are stored within the channels forming sides 12, 13 and 15. Thus, for example, one each of the vertical supports 4 has been inserted through apertures 16 and 18 for storage in sides 12 and 13, while the horizontal shaft 6 has been inserted through aperture 20 for storage within side 15. As illustrated in FIG. 2, two of the bases 2 may be positioned upper face to upper face so that studs 24 in each base index or mate with apertures 26 in the opposite base and the handles 22 are in contact with each other. In this way, two of the reel supports may be carried essentially as a single unit. The reel supports of the present invention may be stacked for storage and/or transport by stacking the units with the base surface of one unit resting on the top surface of a lower unit whereby studs 24 of the lower unit index or mate with apertures 27 disposed in the lower surfaces of the upper unit. In this manner, as many units as are desired may be stacked for storage and/or transport. By stacking the units together as described, the units will be held together essentially as a single unit. This arrangement avoids sliding or rattling of the devices when being transported from one job location to another in a vehicle.

Figure 3:
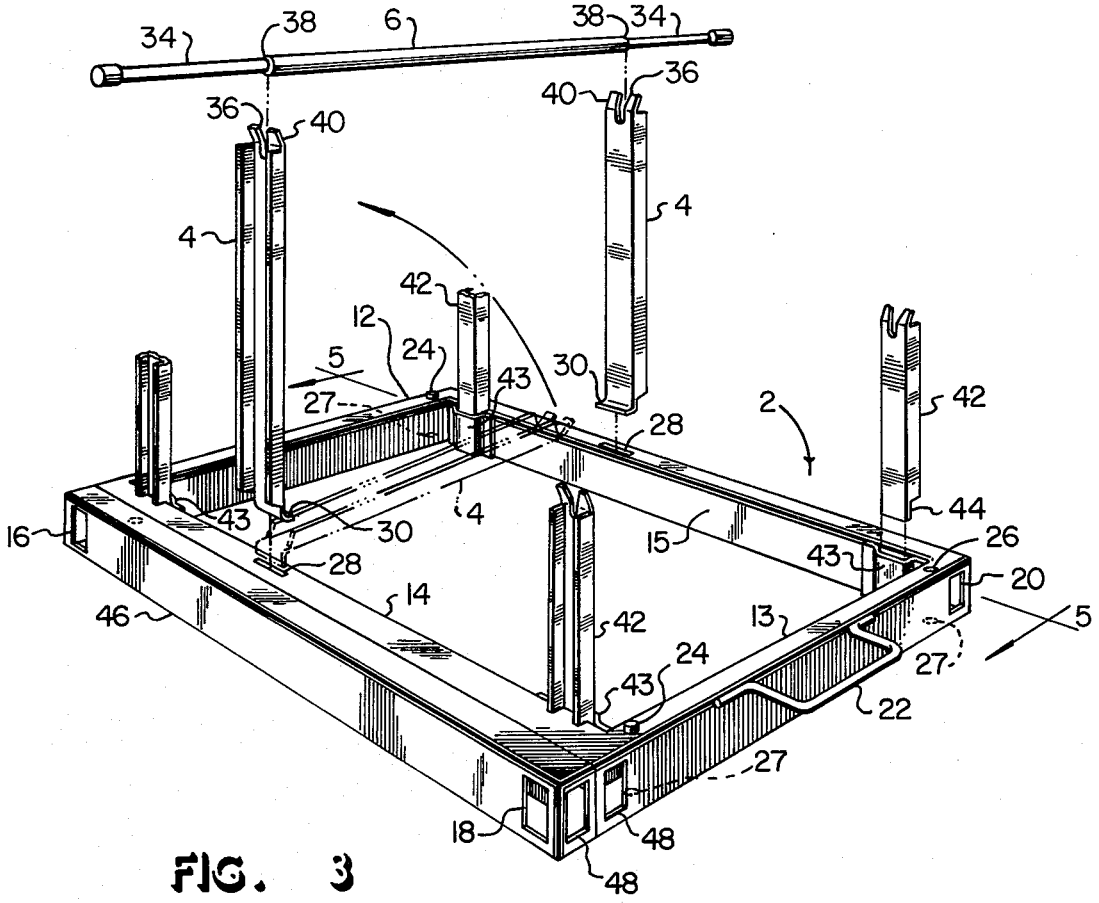
FIG. 3 is a perspective exploded view of the apparatus of FIG. 1 and various modifications thereof.
Figure 4:
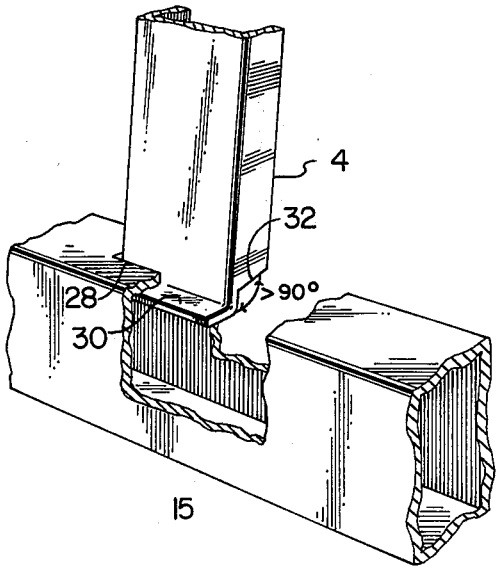
FIG. 4 illustrates the details of one method of anchoring vertical support members to the base.

With reference now to FIG. 3, more details of the apparatus in FIG. 1 are illustrated along with several contemplated modifications. In particular, the vertical supports 4 and horizontal shaft 6 are shown in exploded view to better illustrate their details and manner of interconnection. The means for anchoring the vertical supports 4 to the base 2 includes narrow slots 28 in the upper faces of sides 14 and 15 and angular anchors 30 formed from the web portion of vertical supports 4. Each of these elements is shown in even more detail in FIG. 4. The length and width of channel slots 28 are slightly greater than the width and thickness of the web portion of vertical support 4 forming the anchor 30. It can be seen that the anchor 30 may be formed by cutting away a portion of the arms of the C-channel member 4 at 32, preferably leaving the end of these arm portions at an angle slightly greater than 90° as illustrated in FIG. 4. The arm portions rest on the top face of sides 14 and 15 in use and by slanting the ends of the arms, the vertical supports 4 lean outwardly away from each other to make assembly of the device easier. In this installed position, the anchor 30 contacts the inner surface of the top face of channel member 15.

The assembly of the device can be understood with reference to FIG. 3 where a third vertical support 4 is shown in phantom in a horizontal position. The element 4 is installed by first laying it in a horizontal position so that the angular anchor 30 slides into a slot 28 whereupon member 4 may then be rotatably raised to the vertical position. Due to the slanted ends of the C-channel arms at 32, the vertical support 4 will stop at a position beyond vertical at which it leans outwardly away from the opposing support 4. Normally the vertical supports will lean outwardly at an angle of less than about 15° from the vertical. It can be seen that when the opposing supports 4 are both thus installed, they will be held in their proper position by the force of gravity. This greatly simplifies the positioning of shaft 6 on vertical supports 4. Shaft 6 is installed by placing reduced diameter portions 34 within slots 36 on the upper end of supports 4. When shaft 6 is lowered into position, shoulders 38 engage slanted surfaces 40 on supports 4, thus spreading supports 4 further apart and removing any slack from the system. While the installation of shaft 6 appears fairly simple, it must be remembered that the reels of wire 8, illustrated in FIG. 1, must be placed on shaft 6 before it is installed on supports 4. The wire reels, which may be up to two feet in diameter, are often quite heavy so that the handling of shaft 6 with reels in place is not a simple matter.

Some other embodiments of the invention in addition to those shown in FIG. 1 are illustrated in FIG. 3. These include two additional pairs of vertical support elements 42 spaced laterally from the pair 4. The additional supports 42 may be identical to the supports 4, except for length. Where, for example, supports 4 are twelve inches long, the two additional pairs may be nine and fifteen inches long so that three rows of cable reels may be supported and used simultaneously without interference with each other. It is understood, of course, that an additional horizontal shaft 6 would be supplied for use with each of the additional pairs of vertical supports. Likewise, additional slots may be provided in the upper face of sides 14 and 15 of the base for anchoring the vertical supports. An alternate anchoring means is illustrated for the extra vertical supports 42. This includes stirrups 43 welded to the inner faces of sides 14 and 15 and straight extensions 44 of the web of supports 42. The supports 42 are installed by simply slipping extensions 44 straight down into slots formed between stirrups 43 and sides 14 and 15. This arrangement has the advantage of positively holding supports 42 in place during installation of shafts 6 without depending on the gravitational effect discussed above. In addition, it reduces the maximum dimensions of supports 42 and may allow more than one support to be stored in a single side of the base 2. Since the arms of the C-channel are not needed to retain the supports 42 in a vertical position, it can be seen that a simple flat bar or other channel shapes such as L or T could also be used. The flat bar would be most desirable since a number could be stacked for storage.

An additional means for storing the extra supports 42 is a second hollow channel member 46 forming part of side 14 of base 2. If the length of side 14 is sufficient, two or more of the vertical supports 42 may be stored within a single channel. The other sides, 12, 13 and 15, may likewise be formed from double channel members providing additional storage space in the manner herein illustrated.

Figure 5:
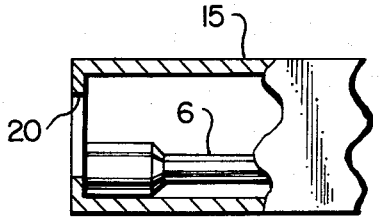
FIG. 5 is a cross-section illustration of the manner in which elements are stored within the hollow channel members of the base.

FIG. 5 is a cross section through one end of side 15 of base 2. This illustrates the aperture 20 in the end of side 15 and the manner in which shaft 6 is prevented from sliding out of the aperture when the apparatus is stored laying flat. As noted above, aperture 20 is somewhat smaller than the inside dimensions of the channel forming side 15. As a result, a small shoulder or flange remains around all edges of aperture 20. When the device is laid flat for storage, the shaft 6 stored within channel 15 is pulled by gravity to the bottom of the channel. In this position, it is prevented from sliding out of aperture 20 by contact with the shoulder. In similar manner, the vertical supports 4 are prevented from sliding out of apertures 16 and 18 while the device is being carried by hand or transported in a vehicle laying flat. An additional means for holding parts within apertures 16 and 18 when base 2 is hand carried is provided by apertures 48 (FIG. 3) providing access to both hollow channels of side 14. If vertical supports are stored in sides 12 and 13 by means of apertures 16 and 18, shafts 6 stored in channels 14 will prevent the supports from sliding out.

The use of apparatus according to the present invention is well illustrated by the above described drawings. One or more of the devices may be carried to a work location as illustrated in FIG. 2. At the point of use, the devices are separated and vertical supports 4 and horizontal shaft 6 are removed from their storage locations within the channels forming the sides of base 2. This is done simply by rotating the base 2 to positions at which each of the apertures 16, 18 and 20 face downward and shaking the base 2 until the stored elements slide from the apertures under the force of gravity. The vertical supports are then anchored in slots, as illustrated in FIG. 3, and placed in their upright position. Reels of wire are then installed on shaft 6, which is then in turn positioned on the vertical supports 4. After the desired amount of wire has been unreeled, the apparatus may be disassembled by reversing the assembly steps.

While the present invention has been illustrated and described in terms of specific apparatus, it is apparent that other modifications or changes can be made within the scope of the present invention as defined by the appended claims.

I claim:

1. A portable cable reel holder comprising:

a rectangular base having four sides, each side comprising at least one hollow channel member having upper and lower faces, wherein three or more of said channel members have an aperture for providing access to the interior of the hollow members, and an opposite pair of said sides has means for anchoring vertical support elements, a first pair of vertical support elements having means on a first end of each for anchoring to said opposite pair of sides, and means on a second end of each for supporting a shaft, and a generally cylindrical shaft adapted for support on said second ends of said first pair of support elements, wherein the dimensions of said hollow channel members, said support elements, and shaft are selected so that said support elements and said shaft may be stored within said hollow members.

2. Apparatus according to claim 1 wherein the opposite pair of sides of said base have rectangular slots on the upper face for anchoring said vertical support elements, and said vertical support elements each comprise a C-channel member having a portion of the arms of the C-channels removed at said first end, and the web portion at said first end curved to engage a slot in the upper face of said opposite sides.

3. Apparatus according to claim 1 further including one or more additional pairs of vertical support members having means on a first end of each for anchoring to said opposite of said four sides, and means on a second end of each for supporting a shaft, and one or more additional generally cylindrical shafts adapted for support on said second ends of said additional pairs of vertical support members.

4. Apparatus according to claim 1 further including, a carrying handle attached to one side of said base, adjacent the upper face of said side, and stacking means comprising alignment studs and holes on at least said upper face of at least two of said sides, whereby when two of said bases are positioned upper face to upper face, said alignment studs and holes interlock and carrying handles on each are aligned.

5. Apparatus according to claim 1 further including alignment studs on said upper faces of at least two of said sides and corresponding alignment holes on said lower faces of said at least two sides, whereby, when two of said bases are stacked lower face to upper face, said alignment studs and holes interlock.

6. Apparatus according to claim 1 wherein said means for anchoring vertical support elements carried by said opposite pair of sides comprises a stirrup bonded to said sides adjacent said upper face forming a slot between said stirrup and said sides, and said means on said first end of each vertical support for anchoring comprises a flat bar extending from said first end and adapted to slide into the slot between said stirrups and said sides.

7. Apparatus according to claim 1 wherein said apertures are smaller than the inside dimensions of said channels thereby forming shoulders around the inner edges of said apertures for retaining stored elements within said hollow channel members.

* * * * *